US006845591B1

(12) United States Patent
van Paassen et al.

(10) Patent No.: US 6,845,591 B1
(45) Date of Patent: Jan. 25, 2005

(54) HOLLOW-CORE SLAB FOR FORMING A FLOOR FIELD IN WHICH DUCTS CAN BE INCORPORATED, AND METHOD FOR FORMING A FLOOR FIELD WITH DUCTS USING SUCH HOLLOW-CORE SLABS

(75) Inventors: Adrianus Gerardus M. van Paassen, Heelsum (NL); Ronald Klein-Holte, Rozendaal (NL); Dick Stoll, Oss (NL)

(73) Assignee: VBI Ontwikkeling B.V., Huissen (NL)

( * ) Notice: Subject to any disclaimer, the term of this patent is extended or adjusted under 35 U.S.C. 154(b) by 0 days.

(21) Appl. No.: 10/088,109

(22) PCT Filed: Sep. 25, 2000

(86) PCT No.: PCT/NL00/00687

§ 371 (c)(1),
(2), (4) Date: Jul. 30, 2002

(87) PCT Pub. No.: WO01/21905

PCT Pub. Date: Mar. 29, 2001

(51) Int. Cl.[7] ..... E04C 2/52

(52) U.S. Cl. ..... 52/220.1; 52/220.3; 52/503; 52/606; 52/607

(58) Field of Search ..... 52/220.1, 503, 52/606, 607, 741.1, 100, 220.3, 220.4, 220.5, 220.7, 220.8; 264/138, 148–151, 155–157, 177.11–177.12, 333.11, 333.12

(56) References Cited

U.S. PATENT DOCUMENTS

| | | | | | |
|---|---|---|---|---|---|
| 1,377,149 | A | * | 5/1921 | Hadland | 52/600 |
| 1,385,299 | A | * | 7/1921 | Bilque | 52/98 |
| 1,501,709 | A | * | 7/1924 | Grueby | 52/425 |
| 2,198,688 | A | * | 4/1940 | Williamson | 138/115 |
| 2,902,854 | A | * | 9/1959 | Greene | 52/145 |
| 2,997,770 | A | * | 8/1961 | Beltz | 264/28 |
| 3,087,575 | A | * | 4/1963 | Baruch et al. | 181/285 |
| 3,286,418 | A | * | 11/1966 | Radford | 52/223.6 |
| 3,855,752 | A | * | 12/1974 | Aylon | 52/605 |
| 3,908,324 | A | * | 9/1975 | Stout | 52/100 |
| 4,514,949 | A | * | 5/1985 | Crespo | 52/603 |
| 4,566,235 | A | * | 1/1986 | Groll | 52/220.2 |
| 4,996,810 | A | * | 3/1991 | Forde | 52/220.3 |
| 5,035,100 | A | * | 7/1991 | Sachs | 52/745.05 |
| 5,291,713 | A | * | 3/1994 | Brechbuhler | 52/606 |
| 5,644,887 | A | * | 7/1997 | Gerhaher et al. | 52/606 |
| 6,526,710 | B1 | * | 3/2003 | Killen | 52/220.1 |

FOREIGN PATENT DOCUMENTS

| | | |
|---|---|---|
| DE | 4006529 A1 | 9/1991 |
| EP | 0028594 | 5/1981 |
| EP | 0 516 139 | 12/1992 |
| EP | 634966 | 5/1996 |
| EP | 0 825 307 | 2/1998 |
| FR | 2667337 | 4/1992 |
| FR | 2770239 | 4/1999 |

* cited by examiner

*Primary Examiner*—Jeanette Chapman
(74) *Attorney, Agent, or Firm*—Jacobson Holman PLLC

(57) ABSTRACT

A hollow-core having a first and a second supporting edge to enable a supported floor field to be formed, and including a concrete bottom layer and a concrete top layer connected therewith, while in the bottom layer, from one supporting edge to the other supporting edge, a longitudinal reinforcement is provided. The bottom layer is made of thicker design than the top layer and dimensioned such that it can take up and transmit to the supporting edges the transverse forces, and if desired also the bending forces, expected and foreseen for the hollow-core slabs, so that without any constructional problems, slots extending down to the bottom layer can be provided in the hollow-core slab, for accommodating ducts therein after the rough structure phase. The provision of the slots can be done both at the time of fabricating the hollow-core slabs and on the building site, while filling of the slots can be done in the construction finishing phase with a less high-grade material than concrete.

8 Claims, 1 Drawing Sheet

HOLLOW-CORE SLAB FOR FORMING A FLOOR FIELD IN WHICH DUCTS CAN BE INCORPORATED, AND METHOD FOR FORMING A FLOOR FIELD WITH DUCTS USING SUCH HOLLOW-CORE SLABS

This invention relates to a hollow-core slab designed to withstand predetermined maximum transverse forces and having a first supporting edge, and a second supporting edge located substantially opposite thereto in the direction of the slab, to enable a supported floor field to be formed, and comprising a concrete upper flange and a concrete lower flange connected therewith by concrete vertical webs, while in the lower flange, from one supporting edge to the other supporting edge, a longitudinal reinforcement wholly surrounded by concrete is provided, and to a method for forming a floor field with ducts using such hollow-core slabs.

With such prefabricated hollow-core slabs, known, for instance, from EP-B-0 634 966, FR-A-2 770 239, FR-A-2 667 337 and European Standard prEN 1168, on a building site, a floor field can be formed fast and efficiently, being supported along its supporting edges by bearing construction parts, such as walls and beams. Installing lines, pipes and tubes in the floor field can be done without many problems if those elements extend in the direction of the longitudinal reinforcement. In fact, providing a longitudinal slot in a hollow-core slab for accommodating such an element therein actually does not amount to more than separating the hollow-core slab at least partly in the longitudinal reinforcement direction, that is, as it were, separating the hollow-core slab into several beam-shaped parts, which does not need to have any, or hardly any, adverse effect in terms of strength technique.

A problem, however, is the installation of ducts, tubes and conduits at an angle, and more particularly transversely to the direction of the longitudinal reinforcement. Although, depending on the application in a given case, the passage of the channels in the hollow-core slab can be reduced to a minimum, that is, a hollow-core slab with hardly any or no channels, it will be preferred to design the lower flange and the upper flange to be approximately equally thick, and as thin as possible, that is, in cooperation with the vertical webs which connect the two flanges and together with these form the channels have a thickness such that the expected and anticipated occurring transverse and bending forces can be reliably taken up. If this multiply hollow girder configuration is interrupted by a transverse slot, this has a considerable adverse effect on the strength of the hollow-core slab and accordingly entails the necessity of performing all kinds of laborious activities, such as the provision of supporting constructions, for instance by strutting the strength-impaired floor by propping it up, filling up the slot again with high-grade material after placing an element therein after optionally providing a reinforcement, and, after hardening, removing the supporting constructions again. What is more, those activities are typically to be performed on the construction site itself, and hence in a less controlled manner, and thereby disturb and delay the progress of the building process.

In practice, all those problems often have as a consequence that hollow-core slabs are left substantially intact, that is, that no slots are provided therein, such that the strength is temporarily unduly affected. Accordingly, for installing ducts, pipes and the like in a floor, often a different building procedure is used, such as, for instance, prefabricating just a lower flange and, after placing that lower flange on a supporting construction, placing thereon the elements to be accommodated in the floor, whereafter the upper flange is poured in situ. This not only yields a floor which is inaccessible during hardening, but also means that during this building phase installers for placing the elements should be present, at least temporarily, on the building site.

The object of the invention is to improve the construction of the known hollow-core slab, such that providing slots therein in a variety of directions does not necessarily affect the required strength of the hollow-core slab.

Another object of the invention is to enable slots to be provided before the hollow-core slab is transported to the building site.

This is achieved in a hollow-core slab of the kind described in the opening paragraph hereof if the lower flange has a thickness larger than the thickness of the upper flange and is dimensioned such that said lower flange can withstand and transmit said predetermined maximum transverse forces to said supporting edges. Through these measures, providing a slot in whatever direction from the top surface as far as the lower flange will not affect the required strength of the hollow-core slab as regards transverse forces to be taken up. This means that in the areas adjacent the supporting edges, any desired transverse or diagonal slot can be provided without this necessitating any additional supporting constructions to be provided and any activities for restoring the hollow-core slab again, and this even for providing, during the building activities, an additional slot which had not been taken into account in the design.

Moreover, installing the elements to be accommodated in the floor can be done after the rough structure phase, that is, simultaneously with the installation of pipes, conduits, ducts and the like above the floor. The installers of those elements therefore do not need to be present on the building site during the rough structure phase, not only because the slots can remain open throughout the rough structure phase, but also because the slots, on account of the constructionally adequate inherent strength of the hollow-core slabs with slots, after placing the elements therein, can be filled up with less high-grade material, for instance during the finishing of the floors by specialized personnel. In other words, each group of personnel trained for a particular task can complete its task without interruption and does not need to be present during different non-consecutive phases. This increases building efficiency, simplifies the construction planning activities, and lowers costs.

Providing such a slot in the central area of the hollow-core slab might present problems. Naturally, the strength can then be restored again by filling up as referred to above. However, it is also possible to work with slots from the central area in the longitudinal direction of the slab and in the supporting edge area in transverse direction. According to a further embodiment of the invention, however, it is in a hollow core-slab designed to withstand predetermined maximum bending forces also possible that the lower flange has such a thickness that said lower flange can withstand and transmit said predetermined maximum bending forces to said supporting edges.

Owing to the fact that the hollow-core slab according to the invention can be made of such strong design that without any problems, that is, without necessitating any additional strengthening measures, slots can be provided, it is possible, in accordance with a further embodiment of the invention, that during the manufacturing process of the hollow-core slab, starting from the upper flange, at least one slot is recessed, which in the direction of the vertical webs extends maximally as far as the lower flange, said at least one slot extends at an angle with respect to the longitudinal reinforcement. Indeed, the strength of the hollow-core slab is such that the slab, also with a slot or slots provided therein, even if the at least one slot extends through at least one vertical web, can be transported from its prefabrication site to the building site, which further promotes the progress of the building process in particular during the rough structure phase.

When the lower flange and the upper flange are connected by mutually spaced concrete vertical webs extending in the direction of the longitudinal reinforcement, the at least one slot can extend in the height direction into the vertical webs as far as the point where the vertical webs link up with the lower flange. This means that the at least one slot may be provided exclusively in the upper flange, or can have a height equal to that of the upper flange plus that of the vertical webs, or the height of the upper flange plus a part of the height of the vertical webs, depending on and adjusted to the element to be accommodated in the slot, this last also applying to the width of the slot.

The object of the invention will typically be achieved, in the hollow-core slabs commonly used in practice, when, while keeping the thickness of the upper flange the same, the thickness of the lower flange is in the order of magnitude of at least twice the thickness of the upper flange.

The invention further relates to a method for forming a floor field in which ducts are incorporated using hollow-core slabs according to the invention, wherein, as known, the hollow-core slabs are laid by their supporting edges on a supporting construction. To enable such a floor field to be suitably provided with ducts, it is proposed, according to the invention, that at a desired point and in a desired direction a slot reaching maximally as far as the lower flange is provided in at least one of the hollow-core slabs; after completing the floor field, ducts are placed in the slots, which can be done simultaneously with ducts to be placed above the floor field; and subsequently the slots are filled up, which can be done simultaneously with the finishing of the floor field. The provision of slots in hollow-core slabs according to the invention, as explained in the foregoing, is possible without any problem; the strength of the building to be erected is not thereby unacceptably affected. This means that erecting the building, the rough structure phase, can be completed before a start is made with placing the ducts in the slots, that is, placing the ducts can be done at the time which is optimal from a planning point of view, for instance simultaneously with the ducts, pipes, tubes, and the like, to be arranged above the floor field. This means that those who are to install the ducts and the like, can carry out and finish their work in one operation, instead of doing so phased in time. This increases building efficiency and reduces the building costs.

The speed of working on the building site can be increased still further, if the slot is provided in the concrete while still unhardened, which makes the provision of the slot a part of the prefabrication of the hollow-core slabs. Another option, however, is to provide the slot after placing the hollow-core slab on the supporting construction. This option is attractive in particular when the piping diagram is changed at a later time or may yet be changed.

Through the particular construction of the hollow-core slabs according to the invention, it is further possible that the slots, when finishing the floor field, are filled up with a less high-grade material than concrete. This means that filling up the slots has become independent of the rough structure phase, so that personnel trained for the purpose does not need to come back for filling up the slots, but such work can be carried out, for instance, by persons not trained for the purpose, and with material, for instance, a cement-sand mixture or a foaming material, in a later finishing phase.

Referring to exemplary embodiments represented in the drawings, the hollow-core slab according to the invention, though by way of example only, will presently be further discussed. In the drawings.

Figure 1:
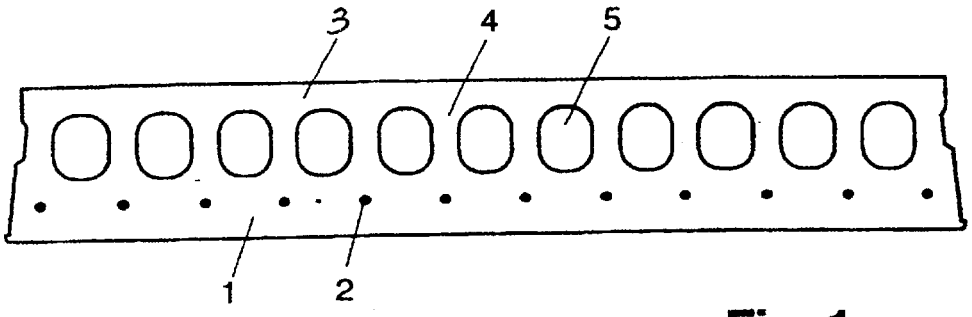
FIG. 1 shows in front view an embodiment of a hollow-core slab according to the invention.

In FIG. 1 a hollow-core slab is represented which is made up of a lower flange 1 with a longitudinal reinforcement 2, a upper flange 3, and vertical webs 4 which connect the lower flange 1 and the upper flange 2 and thus, together with the top and lower flanges, form open channels 5. The lower flange 1, the upper flange 3 and the vertical webs 4 are manufactured from concrete. As appears from FIG. 1, the lower flange 1 is of thicker design than the upper flange 3. By way of exemplary embodiment, the following possible dimensions are given for a hollow-core slab having a dimension of 6 m in longitudinal direction, of 1.2 m in transverse direction and of 0.2 m in vertical direction. When implementing such a slab, a size of 80 mm can be used for the thickness of the lower flange 1, a size of 85 mm for the height of the channels, and a size of 35 mm for the height of the upper flange. The width of the vertical webs at their narrowest point is 35 mm, resulting in a channel width of 65 mm. The longitudinal reinforcement 2 is disposed approximately halfway the height of the lower flange 1. The hollow-core slab can be manufactured by the common known techniques, such as extrusion and sliding methods.

Figure 2:
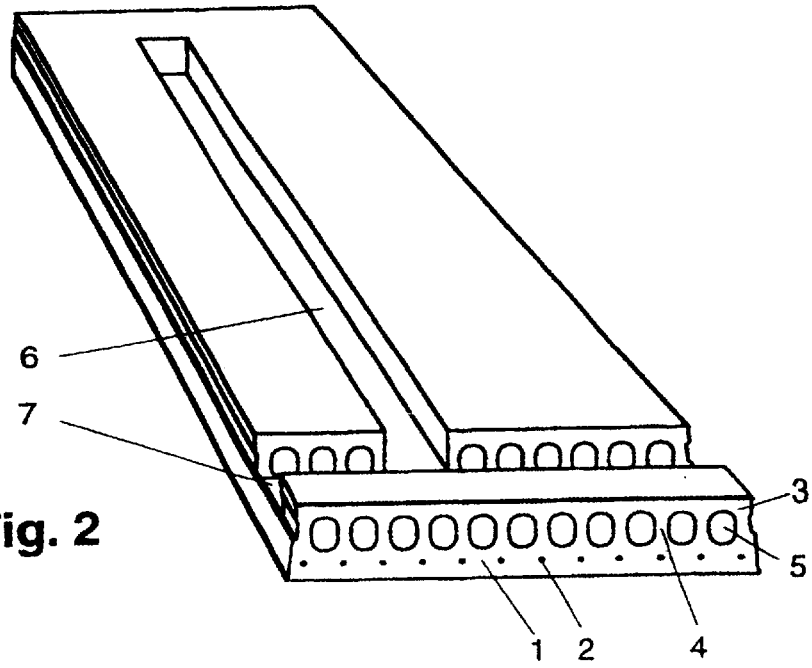
FIG. 2 shows in perspective a hollow-core slab with transverse and longitudinal slot.

FIG. 2 shows a hollow-core slab of the type according to FIG. 1, in which a longitudinal slot 6 has been recessed, which has a depth equal to the height of the upper flange 3 plus the vertical webs 4; if desired, the depth can also be lesser or greater. Further, in the hollow-core slab, a transverse slot 7 is present, whose depth is equal to or less than the height of the upper flange 3 plus the vertical webs 4. The thickness of the lower flange 1 has then been chosen to be such that the transverse and bending forces for which the hollow-core slab has been designed can be taken up without any problems.

For the transverse forces and the bending forces, it hardly makes any difference where a longitudinal slot 6 has been provided; as regards the transverse forces, this also holds true for the situation involving a transverse slot 7. As regards the bending forces, however, the situation in the case of a transverse slot 7 is different. According as the transverse slot is located closer to the middle of the hollow-core slab, the bending forces to be taken up by the lower flange 1 adjacent the transverse slot will be greater and hence the lower flange 1 will need to be thicker. A thicker lower flange, however, means an increase of the weight and material use, while a part of the concrete is not needed from the point of view of taking up and transmitting forces. An additional thickening in excess of that needed for taking up the transverse forces by the lower flange 1 alone can be dispensed with if the respective position or positions in the central area of the hollow-core slab are approached by one or a plurality of longitudinal slots 6, while one or a plurality of transverse slots 7 adjacent the supporting edges provide for the desired transverse connection.

Naturally, it is also possible to provide a transverse slot 7 in the central area of the hollow-core slab, to place therein an element to be placed in the floor, and subsequently to fill up the transverse slot again with inter alia concrete, while optionally filling the contiguous open channel ends, such that the required strength of the hollow-core slab is restored again. Although this will be simpler than in a conventional hollow-core slab without thickened lower flange, this still entails laborious, additional activities to be carried out on the building site, with all the attendant disadvantages.

Figure 3:
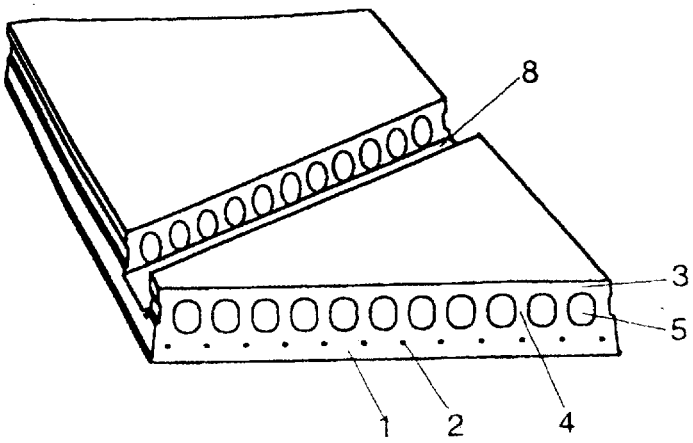
FIG. 3 shows in perspective a hollow-core slab with diagonal slot.

FIG. 3 shows, instead of truly transverse or longitudinal slots, a diagonal slot 8, that is, a slot including an angle deviating from 90° with the longitudinal direction of the hollow-core slab.

As already indicated, the slots are intended for placing therein elements which are to be accommodated in the floor, such as gas pipes, water conduits, electric cable ducts, communication lines, and C.H. pipes, sewer drains, ventilating ducts, etc. Also to be considered here is a space for the countersunk set-up of, for instance, a shower tray. The residual slot space remaining after the placement of the element in question can be filled up again with concrete or similar material. Since the use of such a high-grade material is not needed in terms of strength, however, it is also possible to choose a pure filling material, such as a sand-cement mixture for finishing the floor, or a foamable plastic and the like.

Providing a slot can be done at the building site. It is more efficient, however, to incorporate the provision of the slots into the manufacturing process of the hollow-core slabs. In doing so, provisions can be made which, during the manufacture of the hollow-core slab, prevent concrete from ending up at the place where a slot is to be formed. It is equally possible to provide slots in the still fresh, "green" concrete by removing concrete in a suitable manner before it has hardened. Providing the slots during the manufacturing process is possible without any problem because the hollow-core slabs have been so designed as to be strong enough, with slots, to be transported without any problems from the manufacturing site to the building site.

It will be self-evident that within the framework of the invention as laid down in the appended claims, many other modifications and variants are possible. Thus, the thicker lower flange provides more possibilities for casting in elements during manufacture, which elements, for instance, open in downward direction, for instance ducts for e.g. ventilating or cooling purposes, terminating in the ceiling of the subjacent space. Also, from a point of view of construction, it may be preferred that the open passage of at least a part of the channels is chosen smaller, even down to zero. Nor do all channels need to have the same cross section. The longitudinal reinforcement will typically be prestressed, but this is not requisite. Also, it is possible to provide a reinforcement in the upper flange. Further, for instance in the lower flange, at least locally, transverse reinforcement may be provided. Furthermore, the hollow-core slab can be combined in any desired manner with sound and/or heat insulating materials, on the surface and/or in the channels. For accommodating lines, ducts, pipes, and the like in the floor, use can also be made of channels only in part made accessible by way of the upper flange.

What is claimed is:

1. A hollow-core floor slab designed to withstand predetermined maximum transverse forces and having a first supporting edge and a second supporting edge located substantially opposite thereto in a longitudinal direction of the slab, to enable a supported floor field to be formed, said hollow-core floor slab comprising a concrete upper flange and a concrete lower flange connected therewith by concrete vertical webs, while in the lower flange, from the first supporting edge to the second supporting edge, a longitudinal reinforcement wholly surrounded by concrete is provided, the lower flange having a thickness larger than a thickness of the upper flange and being dimensioned such that said lower flange withstands and transmits said predetermined maximum transverse forces to said supporting edges, and, starting from the upper flange, at least one slot being recessed, which in a vertical direction extends maximally as far as the lower flange, said at least one slot extending at an angle with respect to the longitudinal reinforcement.

2. The hollow-core floor slab according to claim 1, wherein, the lower flange, to withstand predetermined maximum bending forces, has a thickness so that said lower flange can withstand and transmit said predetermined maximum bending forces to said supporting edges.

3. The hollow-core floor slab according to claim 1, wherein the at least one slot extends through at least one of said vertical webs.

4. The hollow-core floor slab according to claim 3, wherein the lower flange and the upper flange are connected by the vertical webs, which extend in the direction of the longitudinal reinforcement, while the at least one slot extends, in a vertical direction, into the vertical webs as far as a point where the vertical webs link up with the lower flange.

5. The hollow-core floor slab according to claim 1, wherein the thickness of the lower flange is in an order of magnitude of at least twice the thickness of the upper flange.

6. The hollow-core floor slab according to claim 1, wherein parts of the slot are filled up with a filling material.

7. The hollow-core floor slab according to claim 6, wherein a less high-grade material than concrete is used as the filling material.

8. The hollow-core floor slab according to claim 1, wherein ducts are cast in the lower flange.

* * * * *